US008578671B2

(12) United States Patent
Labrecque et al.

(10) Patent No.: US 8,578,671 B2
(45) Date of Patent: Nov. 12, 2013

(54) PRESSURE PLATE ASSEMBLY FOR CURTAIN WALL PANELS

(75) Inventors: Normand Labrecque, Beloeil (CA); Christian Lessard, Ile Bizard (CA)

(73) Assignee: Groupe Lessard Inc., Dorval, Québec (CA)

( * ) Notice: Subject to any disclaimer, the term of this patent is extended or adjusted under 35 U.S.C. 154(b) by 155 days.

(21) Appl. No.: 12/781,256

(22) Filed: May 17, 2010

(65) Prior Publication Data

US 2010/0293882 A1 Nov. 25, 2010

Related U.S. Application Data

(60) Provisional application No. 61/179,427, filed on May 19, 2009.

(51) Int. Cl.
*E04B 1/62* (2006.01)

(52) U.S. Cl.
USPC ..... 52/395; 52/467; 52/483.1; 52/235

(58) Field of Classification Search
USPC ..... 52/235, 202, 204.5, 284, 395, 466, 467, 52/474, 483.1, 489.1, 772
See application file for complete search history.

(56) References Cited

U.S. PATENT DOCUMENTS

| | | | | | |
|---|---|---|---|---|---|
| 3,956,863 | A | * | 5/1976 | Tiedeken | 52/204.595 |
| 4,120,127 | A | | 10/1978 | Hubbard | |
| 4,207,717 | A | | 6/1980 | Hubbard | |
| 4,214,415 | A | | 7/1980 | Sukolics | |
| 4,418,506 | A | * | 12/1983 | Weber et al. | 52/209 |
| 4,543,756 | A | | 10/1985 | Kaminaga et al. | |
| 4,599,838 | A | * | 7/1986 | Kaminaga | 52/235 |
| 4,625,482 | A | * | 12/1986 | Kaminaga | 52/235 |
| 4,640,072 | A | * | 2/1987 | Muhle | 52/204.67 |
| 4,683,693 | A | | 8/1987 | Rockar et al. | |
| 5,007,188 | A | | 4/1991 | Feist | |
| 5,018,326 | A | | 5/1991 | Reynolds | |
| 5,058,344 | A | | 10/1991 | Biebuyck | |
| 5,245,808 | A | | 9/1993 | Grunewald et al. | |
| 5,356,675 | A | | 10/1994 | Unger et al. | |
| 5,481,839 | A | | 1/1996 | Lang et al. | |
| 5,490,358 | A | | 2/1996 | Grunewald et al. | |
| 5,544,457 | A | | 8/1996 | Labrecque | |
| 5,546,713 | A | | 8/1996 | Voegele, Jr. et al. | |
| 5,592,795 | A | * | 1/1997 | Rinehart et al. | 52/235 |

(Continued)

FOREIGN PATENT DOCUMENTS

| | | | |
|---|---|---|---|
| CA | 1228708 | A1 | 11/1987 |
| CA | 1235561 | A1 | 4/1988 |

(Continued)

*Primary Examiner* — Brian Glessner
*Assistant Examiner* — Adam Barlow
(74) *Attorney, Agent, or Firm* — Ipaxio S.E.N.C.

(57) ABSTRACT

The pressure plate assembly is used for securing curtain wall panels. The pressure plate assembly includes an elongated base member and an elongated stiffening member. At least a portion of the interior main face of the stiffening member is removably engagable against a corresponding mating surface on the exterior main face of the base member. The stiffening member is made of a material having a mechanical stress resistance higher than that of the material of the base member. At least one longitudinally-extending thermal insulation chamber is provided within a space located between the interior main face of the base member and the interior main face of the stiffening member.

18 Claims, 9 Drawing Sheets

(56) References Cited

U.S. PATENT DOCUMENTS

| | | | | |
|---|---|---|---|---|
| 5,603,585 | A | 2/1997 | Bruchu et al. | |
| 5,687,524 | A * | 11/1997 | Ting | 52/461 |
| 5,802,799 | A | 9/1998 | Thuleskar et al. | |
| 5,893,244 | A | 4/1999 | Magoon | |
| 6,141,923 | A * | 11/2000 | Habicht et al. | 52/235 |
| 6,158,182 | A | 12/2000 | Biebuyck | |
| 6,170,208 | B1 | 1/2001 | Lambiris | |
| 6,421,968 | B2 | 7/2002 | Degelsegger | |
| 6,425,218 | B1 | 7/2002 | Doyon et al. | |
| 6,438,913 | B1 | 8/2002 | Ishikawa et al. | |
| 6,442,907 | B1 | 9/2002 | Doyon et al. | |
| 6,467,226 | B2 | 10/2002 | Dodson et al. | |
| 6,715,248 | B2 | 4/2004 | Biebuyck | |
| 6,735,912 | B2 * | 5/2004 | Riggio | 52/235 |
| 6,804,920 | B2 | 10/2004 | Hogan | |
| 6,993,873 | B2 | 2/2006 | Biebuyck et al. | |
| 7,036,280 | B2 | 5/2006 | Hogan | |
| 7,138,166 | B2 * | 11/2006 | Rinehart et al. | 428/99 |
| 7,334,371 | B2 | 2/2008 | Rinehart et al. | |
| 7,389,617 | B2 | 6/2008 | Grunewald | |
| 2005/0284046 | A1 | 12/2005 | Neal | |
| 2006/0201084 | A1 | 9/2006 | Arias | |
| 2007/0199261 | A1 | 8/2007 | Lang | |
| 2008/0245001 | A1 | 10/2008 | Alkoury et al. | |

FOREIGN PATENT DOCUMENTS

| | | | |
|---|---|---|---|
| CA | 2030660 | A1 | 6/1991 |
| CA | 2202046 | C | 5/1996 |
| CA | 2249513 | F | 4/1999 |
| CA | 2261208 | C | 8/1999 |
| CA | 2261224 | A1 | 8/1999 |
| EP | 1010829 | B1 | 6/2000 |
| EP | 1338713 | B1 | 8/2003 |
| ES | 2257135 | A1 | 7/2006 |
| FR | 2832747 | A1 | 5/2003 |
| GB | 2435652 | B | 9/2007 |
| WO | 8706291 | A1 | 10/1987 |

* cited by examiner

PRESSURE PLATE ASSEMBLY FOR CURTAIN WALL PANELS

RELATED APPLICATION

This application claims the benefit of priority from U.S. provisional patent application No. 61/179,427, filed May 19, 2009, which is hereby incorporated by reference.

TECHNICAL FIELD

The technical field generally relates to curtain walls and to ways of securing panels in a curtain wall.

BACKGROUND

A curtain wall generally includes a plurality of juxtaposed panels secured to a supporting frame and which together often form an exterior wall of a building. Each panel can be made of one or more materials, such as glass, metal, stone and many others, depending on the desired architectural aspect and function of each panel. A curtain wall can have identical panels or have a plurality of different types of panels. These panels are generally connected to beams, called mullions. Each mullion is part of the supporting frame of the curtain wall. The supporting frame is itself anchored or otherwise secured to the main building structure. A curtain wall often spans multiple floors. Other applications and configurations also exist.

The design of a curtain wall often involves dealing with many different design requirements at the same time. Some of these design requirements can include, for instance, preventing air and water infiltration over the years, resisting to possible high wind forces acting on the building, resisting to possible seismic events, minimizing thermal transfers during cold and/or hot weather conditions, allowing thermal expansion and contraction of the materials due to temperature changes, resisting to building sway and movement, allowing panels to be easily replaced when needed, etc. Fulfilling multiple design requirements while keeping the manufacturing and installation costs to a minimum can sometimes be very challenging. Room for improvements thus always exists in this area.

SUMMARY

In one aspect, there is provided a pressure plate assembly for securing curtain wall panels, the pressure plate assembly including: an elongated base member having opposite exterior and interior main faces and having opposite lateral edges, the base member being made of a first material; an elongated stiffening member having opposite exterior and interior main faces and having opposite lateral edges, at least a portion of the interior main face of the stiffening member being removably engagable against a corresponding mating surface on the exterior main face of the base member, the stiffening member being substantially similar in length to the base member and being made of a second material having a mechanical stress resistance higher than that of the first material; and at least one longitudinally-extending thermal insulation chamber provided within a space located between the interior main face of the base member and the interior main face of the stiffening member.

In another aspect, there is provided a method of securing a panel to a supporting frame of a curtain wall, the method including: connecting together an elongated base member and a corresponding elongated stiffening member, both remaining selectively removable from one another after being connected; and attaching the base member and the stiffening member to the supporting frame using a plurality of longitudinally spaced-apart fasteners, each fastener extending in a corresponding fastener hole provided across the base member and the stiffening member, each fastener generating a compressive force transmitted to the stiffening member around a periphery of the corresponding fastener hole, the compressive force from the fasteners being transmitted to the base member by the stiffener member.

Further details on these aspects as well as other aspects of the proposed concept will be apparent from the following detailed description and the appended figures.

DETAILED DESCRIPTION

Figure 1:
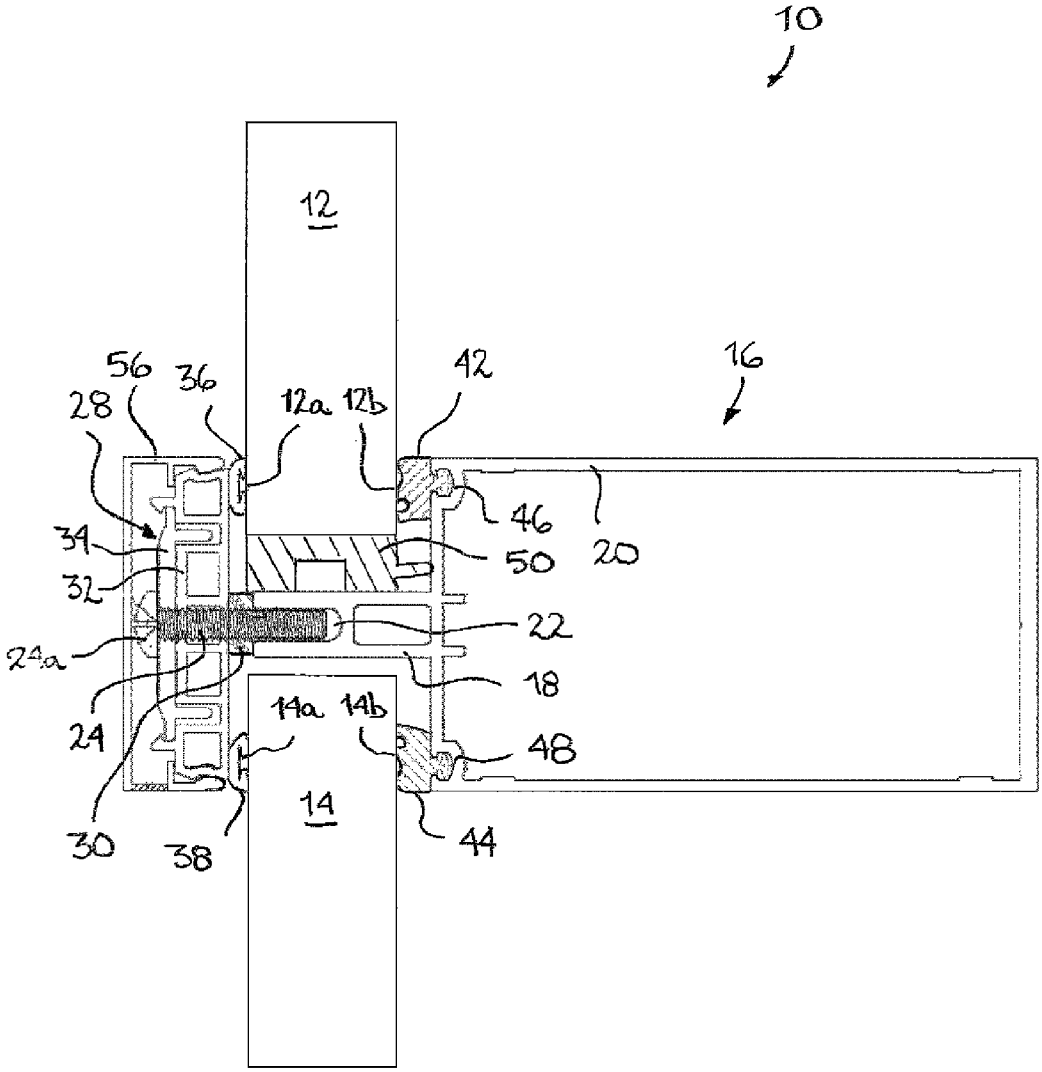
FIG. 1 is a widthwise cross-sectional view illustrating an example of a portion of a curtain wall incorporating an example of a pressure plate assembly depicting the proposed concept.

FIG. 1 is a widthwise cross-sectional view illustrating an example of a portion of a curtain wall, which portion is referred to hereafter as the curtain wall portion 10. The illustrated curtain wall portion 10 includes two generic curtain wall panels 12, 14 juxtaposed in a vertical plane. In this arrangement, the perimeter of each panel 12, 14 is designed to be secured to vertical and horizontal mullions. These mullions can be made, for instance, of aluminum or an alloy thereof. Other materials can also be used as well. In FIG. 1, the exterior of the curtain wall 10 is at the left and the interior is at the right.

Figure 2:
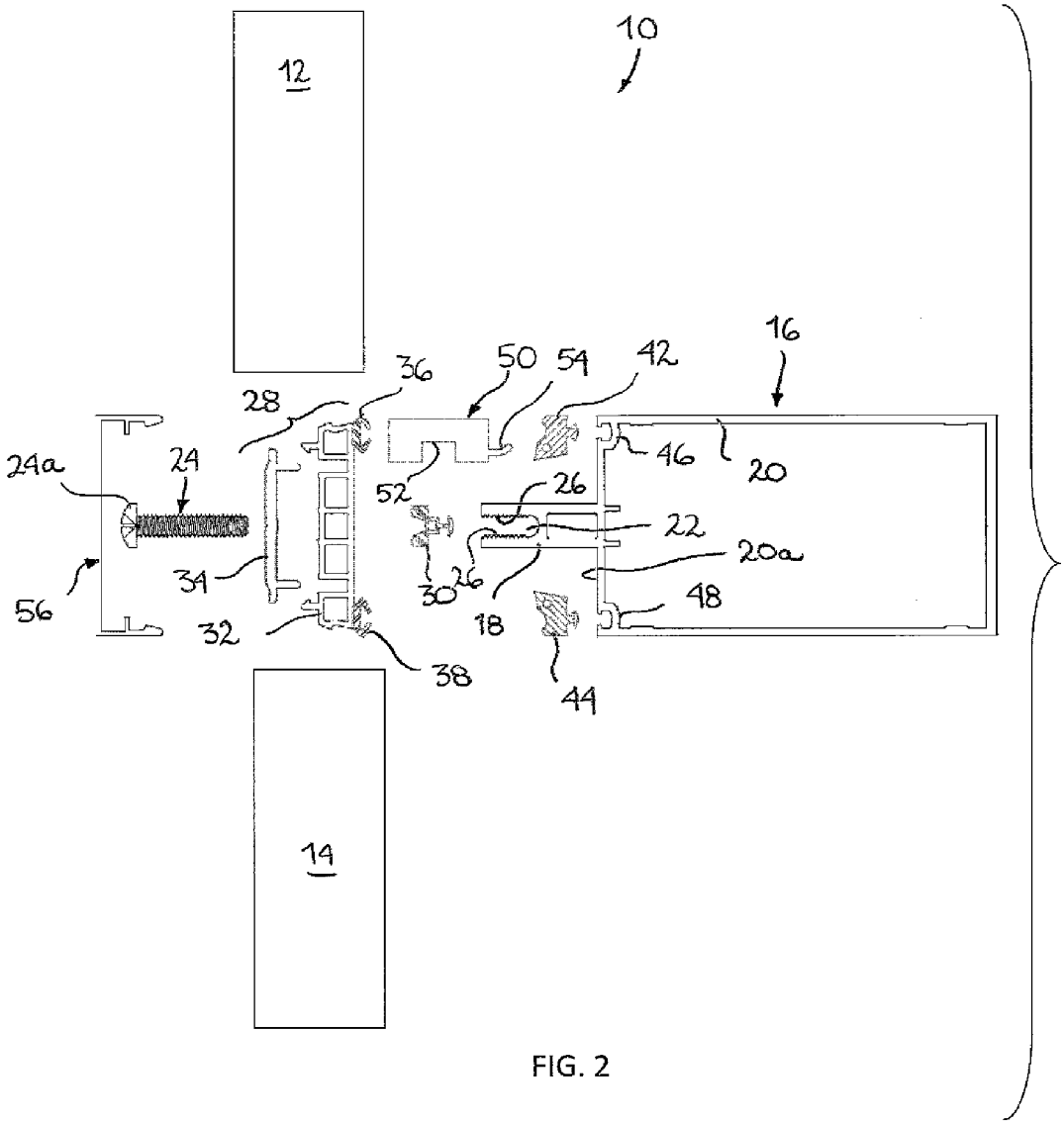
FIG. 2 is an exploded view of the parts shown assembled in FIG. 1.

FIG. 1 shows a horizontal mullion 16 having a flanged portion 18 projecting outwardly from a main section 20 of the horizontal mullion 16. The flanged portion 18 extends substantially along the entire length of the horizontal mullion 16 and includes an opened channel 22 along the free end thereof, as best shown in FIG. 2. FIG. 2 is an exploded view of the parts shown assembled in FIG. 1. This channel 22 can receive fasteners, for instance self-tapping screws or bolts. FIGS. 1 and 2 show an example of a fastener 24. The fastener 24 is designed to engage opposite walls 26 inside the channel 22 of the flanged portion 18. As best shown in FIG. 2, the opposite walls 26 include serrations for cooperating with the outer threads of the fastener 24. This fastener 24, together with other fasteners installed along the length of the horizontal mullion 16, is used to removably connect a pressure plate assembly to the horizontal mullion 16. An example of a pressure plate assembly is shown in FIGS. 1 and 2 at 28.

In use, the pressure plate assembly 28 extends parallel to the horizontal mullion 16 and engages simultaneously the two panels 12, 14. As shown in FIG. 1, the pressure plate assembly 28 engages a bottom exterior peripheral surface 12*a* of the top panel 12 and a top exterior peripheral surface 14*a* of the bottom panel 14. Four pressure plate assemblies similar to the one illustrated in FIG. 1 would be provided all around the perimeter of each panel 12, 14. Two are disposed horizontally and two are disposed vertically. Together, these pressure plate assemblies cover substantially the entire space around the perimeter of each panel 12, 14 so as to secure them to the corresponding mullions. Expansion joints can be provided between some pressure plate assemblies to compensate for the thermal dilatation of the materials and the sway of the building, for instance. Still, a single strip of the pressure plate assembly can span across more than one panel in a given direction. Other configurations and arrangements are also possible.

In the example shown in FIGS. 1 and 2, a longitudinally-extending seal 30 is provided between the pressure plate assembly 28 and the front edge of the flanged portion 18 of the horizontal mullion 16. This seal 30 can be made of a material mitigating thermal transfers between the pressure plate assembly 28 and the horizontal mullion 16. It can also act as a spacer and a water barrier preventing or mitigating spillage of the water from the space above the top side of the horizontally-disposed flanged portion 18 to the space below the bottom side thereof. The seal 30 can cooperate with corner blocks (not shown) provided at the junctions of horizontal and vertical mullions to retain water at the bottom perimeter of the panel 12 before or during the drainage process. Keeping water above the flanged portion 18 can also help identifying the location where maintenance is required if water also infiltrates inside the building.

The pressure plate assembly 28 includes an elongated base member 32 and an elongated stiffening member 34 removably engagable to one another at a mating surface. The illustrated pressure plate assembly 28 also includes two spaced-apart gaskets 36, 38 attached to the base member 32 on the side facing the panels 12, 14. The base member 32, the stiffening member 34 and the gaskets 36, 38 have a widthwise cross-sectional profile that is symmetrical in the illustrated example. Also, the stiffening member 34 is smaller in width than the base member 32 in the example shown in FIGS. 1 and 2. Other arrangements are possible.

The gaskets 36, 38 extend parallel in a lengthwise direction of the base member 32 and are adjacent to a respective lateral edge 32*a*, 32*b* (FIG. 3) of the base member 32 so as to engage the corresponding one of the exterior peripheral surfaces 12*a*, 14*a* of the panels 12, 14. The gaskets 36, 38 are made of a resilient material, for instance a polymeric material, capable of providing a suitable seal along their entire length without damaging the exterior panel surfaces 12*a*, 14*a*.

The base member 32 can be manufactured by an extrusion process. Other manufacturing processes, however, are also possible. The base member 32 can be made of a material such as polyvinyl chloride (PVC) or another polymeric material. The material can be selected so as to have both a relatively low thermal conductivity and relatively good mechanical properties. Designing the base member 32 with a low thermal conducting material reduces thermal transfers in environments having a relatively high temperature difference between the inside and the outside of the building. For instance, in areas subjected to a cold outside temperature at certain periods of the year, minimizing heat losses is generally very desirable.

Figure 3:
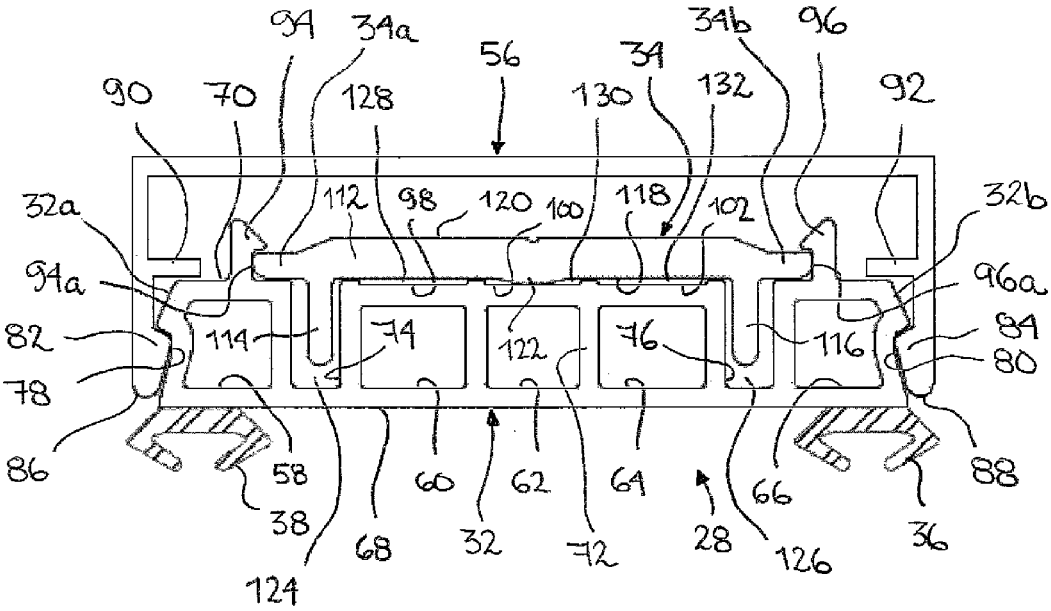
FIG. 3 is an enlarged widthwise cross-sectional view illustrating the pressure plate assembly and the cover plate shown in FIG. 1.

The gaskets 36, 38 of the pressure plate assembly 28 are shown in FIG. 3 as being permanently attached to the base member 32, thereby forming a monolithic part. If an extrusion process is used for manufacturing the base member 32, it is then possible to integrally form the gaskets 36, 38 at the same time upon using a process referred to as a coextrusion. The gaskets 36, 38 have an elastic modulus higher than that of the material of the base member 32 since they are designed to be compressed when installed.

It should be noted at this point that the gaskets 36, 38 shown in FIG. 3 can also be otherwise attached to the base member 32. For instance, the gaskets 36, 38 can be glued to the base member 32 or even attached using fasteners. Other alternatives are also possible, one of which is shown in some of the other examples of the present specification.

As shown in FIG. 1, the bottom interior peripheral surface 12*b* of the top panel 12 and the top interior peripheral surface 14*b* of the bottom panel 14 engage corresponding interior gaskets 42, 44, which interior gaskets 42, 44 are each attached to a corresponding groove 46, 48 provided on the main section 20 of the horizontal mullion 16. The interior gaskets 42, 44 are made of an elastic material, for instance a polymeric material, capable of providing a suitable seal along their entire length without damaging the interior panel surfaces 12*b*, 14*b*.

In use, the heads 24*a* (FIG. 1) of the fasteners 24 are engaged against the exterior main face of the stiffening member 34. The various parts are designed so that upon tightening the fasteners 24 of the pressure plate assembly 28, the stiffening member 34 of the pressure plate assembly 28 will receive the forces coming from the fasteners 24 and transfer them to the base member 32. The forces coming from the fasteners 24 are then transferred to the base member 32 over a much greater area. This way, the pressure plate assembly 28 is reinforced. From the base member 32, the forces go to the gaskets 36, 38 and then the corresponding exterior peripheral surfaces 12*a*, 14*a* of the panels 12, 14. The forces push the panels 12, 14 inwards and their interior peripheral surfaces 12*b*, 14*b* are then urged against the interior gaskets 42, 44. The fasteners 24 are tightened until the optimum compressive forces are reached.

The link between the panel and the heads 24*a* of the fasteners 24 is thus subjected to an intense solicitation. In that context, finding a good compromise between various requirements such as a high mechanical stress resistance, a low thermal conduction, an excellent durability, a low manufacturing cost, a low installation cost, etc, adds to the challenges of designing a curtain wall. Generally, using a relatively low cost material can lead, for example to parts larger in size than what is desirable and/or to a decrease of the spacing between the fasteners. If the fasteners are required to be spaced closer to one another, this may increase the installation costs and decrease the overall thermal insulation efficiency of a curtain wall since more thermal bridges will be created by the increased number of fasteners 24.

In the proposed concept, the stiffening member 34 mitigates this challenge. It has substantially the length of the base member 32 and is made of a material having a mechanical stress resistance higher than that of the material of the base member 32. Following this principle, a designer can select a relatively low cost first material for the base member 32, for instance a polymer, and select a stronger second material for the stiffening member 34, for instance a metal such as aluminum or an alloy thereof, even if this second material does not have good thermal insulation properties. Both members 32, 34 are detachable from one another and can be manufactured separately.

It should be noted at this point that some panels in a curtain wall can be juxtaposed to construction elements on one or more sides thereof. This could be the case, for instance, of panels located in the uppermost row of a curtain wall. The top horizontal pressure plate assembly or assemblies of one of such panels can have one gasket engaging the top exterior peripheral surface of the panel and its other gasket engaging the exterior surface of a construction element filing the empty space above the flanged portion of the top horizontal mullion. Thus, pressure plate assemblies do not necessarily always engage two panels everywhere.

Most of the weight of the top panel 12 shown in FIG. 1 rests on the flanged portion 18 of the horizontal mullion 16 and at least two spaced-apart shims are provided between the bottom of the panel 12 and the flanged portion 18 of the horizontal mullion 16. An example of a shim 50 is shown in FIGS. 1 and 2. The shim 50 can be made, for instance, of a material such as neoprene. The shim 50 in the illustrated example has a bottom central groove 52 (FIG. 2) extending lengthwise in a main section of the shim 50. The groove 52 can act as a water circulation channel allowing infiltrated water to find a way out towards drain holes. More details on this point will be given later in the text. The illustrated shim 50 also includes a spacer portion 54 (FIG. 2) projecting at the rear of the main section of the shim 50. The spacer portion 54 is designed to engage the front surface 20*a* (FIG. 2) of the main section 20 of the horizontal mullion 16 to assist in positioning the shim 50. FIG. 1 shows the shim 50 in position. Other configurations and arrangements are also possible.

FIG. 1 shows that the pressure plate assembly 28 can almost entirely be hidden inside a substantially C-shaped cover plate 56, which cover plate 56 is snap-fitted over the pressure plate assembly 28 in the illustrated example. Variants are also possible. One of the functions of this cover plate 56 is to improve the overall visual aspect once the pressure plate assembly 28 is in place. It can also stop rainwater, sunlight and other elements from directly contacting the pressure plate assembly 28, thereby acting as a rain-screen. This can improve the durability of the pressure plate assembly 28, among other things. The cover plate 56 can be made of metal, for instance aluminum or an alloy thereof. Other materials are also possible as well.

FIG. 3 is an enlarged widthwise cross-sectional view illustrating the pressure plate assembly 28 and the cover plate 56 of FIG. 1. The pressure plate assembly 28 is shown horizontally for the purpose of illustration. As can be seen, the base member 32 of the pressure plate assembly 28 includes a plurality of longitudinally-extending walls forming five longitudinally-extending chambers 58, 60, 62, 64, 66. Air in these chambers 58, 60, 62, 64, 66 acts as a thermal insulator mitigating thermal transfers across the thickness of the pressure plate assembly 28.

The base member 32 has opposite interior and exterior main faces 68, 70. It also has opposite lateral edges 32*a*, 32*b*. The walls of the base member 32 in the illustrated example, which walls are collectively referred to hereafter as the walls 72, also form two longitudinally-extending grooves 74, 76 opened on the exterior main face 70 of the base member 32.

The base member 32 includes longitudinally-extending outer recess 78, 80 on its lateral edges 32*a*, 32*b*. These recesses 78, 80 are designed to be engaged by corresponding inner projections 82, 84 provided on side walls 86, 88 of the cover plate 56. The recesses 78, 80 and the projections 82, 84 are configured and disposed so as to create a removable interfering engagement allowing the cover plate 56 to be snap-fitted to the pressure plate assembly 28. This arrangement can improve the thermal insulation characteristics of a curtain wall since the edges 86, 88 of the cover plate 56 are engaged to the base member 32, which is a part that can be made of a material having high thermal insulation characteristics. Thus, the cover plate 56 in FIG. 3 has no direct contact with the stiffening member 34 or the fasteners 24, both being parts that are often made of a material having a relatively high thermal conductivity, for instance a metal such as aluminum or an allow thereof. Other ways of securing the cover plate 56 to the pressure plate assembly 28 can also be used.

The cover plate 56 illustrated in FIG. 3 includes two inwardly-projecting walls 90, 92 that are configured and disposed to limit the depth of insertion of the cover plate 56 over the pressure plate assembly 28. This can be useful for preventing an accidental contact of the side walls 86, 88 of the cover plate 56 with the exterior surface of the panels 12, 14, for example when the cover plate 56 is installed. Other arrangements and configurations are also possible.

FIG. 3 further illustrates that in the example, longitudinally-extending walls 94, 96 project orthogonally from the exterior main face 70 of the base member 32 The wall 94 is located over the chamber 58 and the wall 96 is located over the chamber 66. Also, each of the three chambers 60, 62, 64 at the center of the illustrated base member 32 includes a respective longitudinally-extending swallow surface groove 98, 100, 102 on the exterior main face 70 of the base member 32.

As best shown in FIG. 3, the stiffening member 34 of the illustrated example includes a main section 112 having a somewhat rectangular cross-sectional profile. The illustrated stiffening member 34 also has two spaced-apart and longitudinally-extending walls 114, 116 projecting orthogonally from an interior main face 118 of the stiffening member 34. The stiffening member 34 also includes an exterior main face 120. The medial region of the surface of the interior main face 118 includes a rounded ridge 122. These features can provide an increased second moment of inertia, thereby increasing the rigidity against flexion.

The illustrated pressure plate assembly 28 is designed so that the projecting walls 114, 116 of the stiffening member 34 are located inside the grooves 74, 76 of the base member 32 when the base member 32 and the stiffening member 34 are engaged together. The height of the walls 114, 116 is, however, shorter than the depth of the grooves 74, 76. This creates a thermal insulation air space between the free end of the walls 114, 116 and the bottom of the corresponding grooves 74, 76. These air spaces are part of thermal insulation air chambers 124, 126 delimited by the interior of the grooves 74, 76 and the stiffening member 34 that closes each groove 74, 76.

In the illustrated example, small thermal insulation channels 128, 130, 132 are also created between the base member 32 and the stiffening member 34 to further improve the overall thermal insulation. The central channel 130 receives the rounded ridge 122. Other arrangements and configurations are also possible as well.

FIG. 3 shows that the longitudinal side edges 34*a*, 34*b* of the stiffening member 34 in the illustrated example are somewhat beveled and their thickness is less than the thickness elsewhere in the stiffening member 34.

The base member 32 and the stiffening member 34 shown in FIG. 3 are designed to be snap-fitted together. Each wall 94, 96 projecting at the exterior main face 70 of the base member 32 includes a corresponding inner groove 94*a*, 96*a*. Both grooves 94*a*, 96*a* face each other and the longitudinal side edges 34*a*, 34*b* of the stiffening member 34 are in a light or moderate interfering engagement with these grooves 94*a*, 96*a* after the assembly. The design of this pressure plate assembly 28 allows removing the stiffening member 34 from the base member 32. The base member 32 and the stiffening member 34 can be brought together during the manufacturing at the plant or on site.

Figure 4:
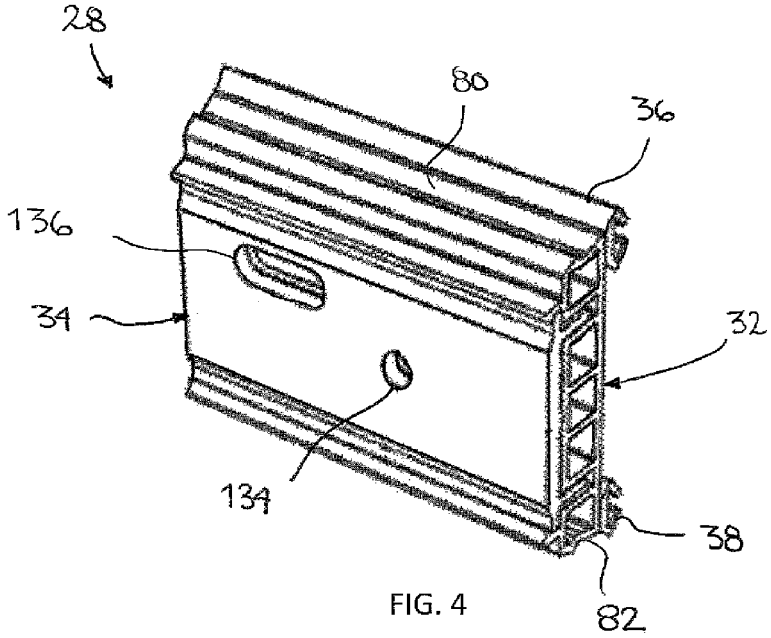
FIG. 4 is an isometric view illustrating the exterior side of a segment of the pressure plate assembly of FIG. 1.

FIG. 4 is an isometric view illustrating the exterior side of a segment of the pressure plate assembly 28 shown in FIG. 1. Only a segment of the pressure plate assembly 28 is shown for the purpose of illustration. The pressure plate assembly 28 would usually be much longer in length compared to what is shown. The exact length of the pressure plate assembly 28, however, depends on the exact application and design. As aforesaid, the length of the base member 32 and that of the stiffening member 34 will often be substantially similar, if not equal. Their length can be selected so that each pressure plate assembly 28 can span uninterruptedly across a given panel. Nevertheless, it would be possible to put multiple shorter segments end to end in a curtain wall instead of using a long uninterrupted strip. It would also be possible to use multiple segments of the base member 32 with a single uninterrupted length of the stiffening member 34, or vice-versa. Still, it would be possible to use multiple segments of the base member 32 with multiple segments of the stiffening member 34, the segments of the base member 32 having at least some of their ends that are not positioned at the same lengthwise location than the ends of the stiffening member 34.

FIG. 4 illustrates one fastener hole 134 provided at the center of the pressure plate assembly 28 for receiving the fastener 24. The fastener hole 134 has a first portion extending across both main faces of the stiffening member 34 and a second portion extending across both main faces of the base member 32. The corresponding first and second portions of each fastener hole 134 are in registry with one another when the pressure plate assembly 28 secures curtain wall panels. A plurality of these spaced-apart fastener holes 134 are provided for a given length of the pressure plate assembly 28. The fastener holes 134 can be made either during the manufacturing of the pressure plate assembly 28 and/or on site. These holes 134 can be machined using methods such as drilling, punching, etc. Their spacing depends on many factors and does not necessarily need to be constant everywhere in a same curtain wall. For instance, the spacing of the fastener holes 134 may be greater at the bottom of a building than at the highest floor thereof. Still, additional fastener holes 134 can be made on site if required, for instance near the corners of some panels. Generally, however, using superfluous fasteners 24 is not necessarily desirable since it can increase the installation time and the overall costs of a curtain wall, for instance.

FIG. 4 further illustrates an example of a weep hole 136 for draining water out of a horizontally-disposed pressure plate assembly 28. Vertically-disposed pressure plate assemblies 28 generally do not have weep holes. A plurality of spaced-apart weep holes 136 can be provided for a given length of the pressure plate assembly 28. The weep holes 136 can be made either during the manufacturing of the pressure plate assembly 28 and/or on site. These holes 136 can be machined using methods such as drilling, punching, etc. The spacing of the weep holes 136 depends on many factors and does not necessarily need to be constant everywhere in a same curtain wall. The number of weep holes 136 is also not necessarily equal to the number of fastener holes 134, although fastener holes 134 and weep holes 136 are generally spaced apart from one another. The illustrated weep hole 136 is oblong in shape but other shapes are possible as well. The weep hole 136 has a first portion made through the base member 32 and a second portion made through the stiffening member 34. Both portions are in registry with one another when the pressure plate assembly 28 secures curtain wall panels but other configurations and arrangements are also possible. Fasteners holes 134 and weep holes 136 can be machined after assembling the base member 32 and the stiffening member 34 together or can be machined before the members 32, 34 are engaged together.

With the weep holes 136, infiltrated water entering behind the pressure plate assembly 28, for instance at the junction of a horizontal and a vertical pressure plate assembly, can be drained out under the effect of gravity. The weep holes 136 can also promote air circulation and equilibrate air pressure between the front face of the mullion 16 and the exterior face of the base member 32.

Figure 5:
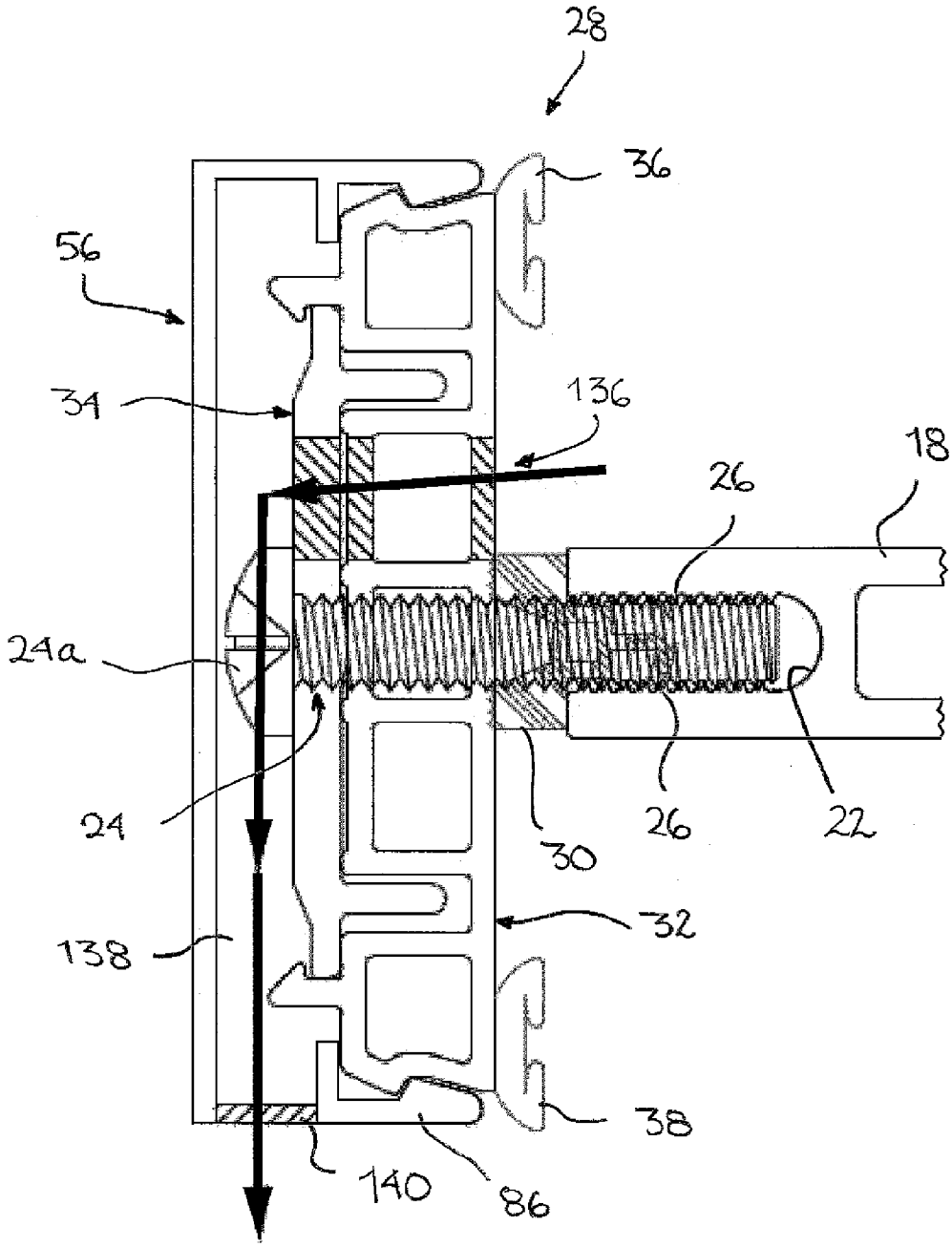
FIG. 5 is an enlarged side view illustrating an example of the path followed by infiltrated water coming out from behind the pressure plate assembly of FIG. 1.

FIG. 5 is an enlarged view illustrating an example of the path followed by water from behind the pressure plate assembly 28 of FIG. 1. The weep hole 136 is positioned so as to be at the bottom of the space in which the panel 12 is provided. Water can then be drained by gravity from behind the pressure plate assembly 28 to the front side thereof. From there, the water falls to the bottom of a longitudinally-extending space 138 formed between the exterior main face of the stiffening member 34 and the interior of the cover plate 56. Spaced-apart holes 140 are provided through the side wall 86 at the bottom of the cover plate 56. The water can then exit the space 138 through these holes 140.

Figure 6:
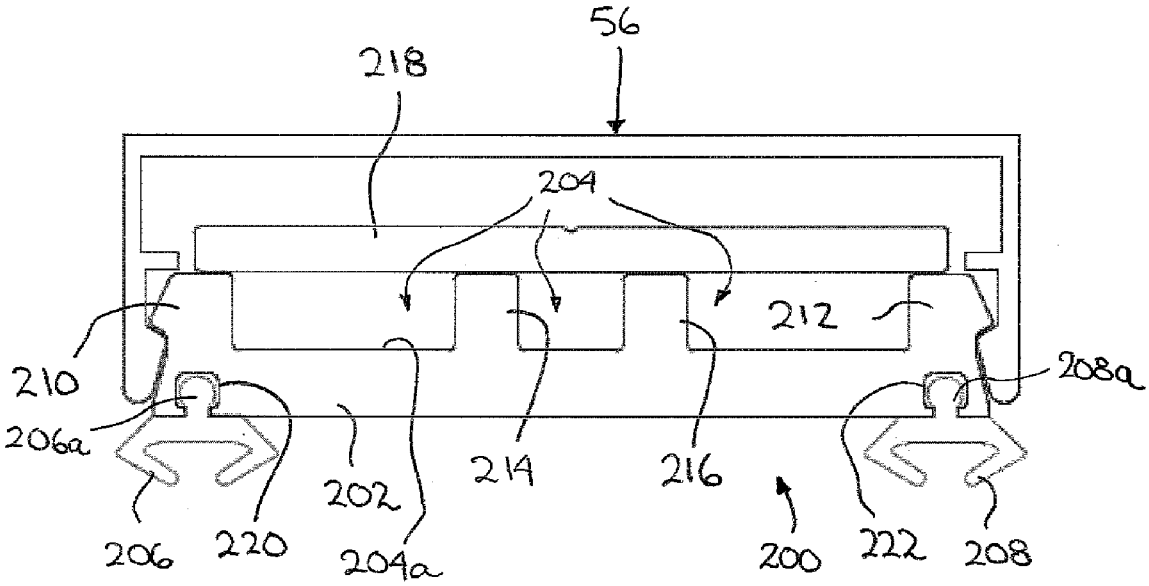
FIG. 6 is a widthwise cross-sectional view illustrating another example of a pressure plate assembly depicting the proposed concept.

FIG. 6 is a widthwise cross-sectional view illustrating another example of a pressure plate assembly depicting the proposed concept. The pressure plate assembly in FIG. 6 is referred to as the pressure plate assembly 200. The pressure plate assembly 200 is shown with the cover plate 56 of the previous example. It should be noted that although the same cover plate 56 is shown with the various examples of pressure plate assemblies, many variants of the cover plate are possible. Still, one can choose to omit the cover plate 56 in some curtain walls or at some locations thereof.

In the example shown in FIG. 6, the base member 202 of the pressure plate assembly 200 includes a longitudinally-extending central grooved portion 204 on its exterior main face and two gaskets 206, 208 on its interior main face. The lateral edges of the central grooved portion 204 are delimited by two side walls 210, 212. Two spaced-apart walls 214, 216 orthogonally project from the bottom surface 204*a* of the central grooved portion 204 near the medial region of the base member 202. The top surface of these walls 214, 216 is at the same level as the top surface of the side walls 210, 212.

The stiffening member 218 of the example shown in FIG. 6 has substantially flat surfaces and a portion of its interior main face engages the top surfaces of the walls 210, 212, 214, 216 of the base member 202, which top surfaces are part of the exterior main face of the base member 202. Three thermal insulation chambers are then formed between the bottom surface 204*a* of the grooved portion 204 of the base member 202 and the interior main face of the stiffening member 218 when they are in a mutual engagement. The center walls 214, 216 in the base member 202 provide an additional support for the forces coming from the fasteners when the pressure plate assembly 200 is installed in a curtain wall. The walls 214, 216 also allow draining any infiltrated water out using weep holes similar to the one shown in the previous example. Furthermore, the stiffening member 218 of the example shown in FIG. 6 is not secured by the base member 202, as is the case in the previous example. Instead, the base member 202 and the stiffening member 218 are attached together by the fasteners holding the pressure plate assembly 200 to the rest of the curtain wall. It is also possible to devise other removable connections or even temporary connections designed to be removed during or after the installation of the pressure plate assembly 200 in a curtain wall.

Furthermore, FIG. 6 illustrates that each gasket 206, 208 of this example has a corresponding rear portion 206*a*, 208*a* that is removably inserted in a corresponding longitudinally-extending groove 220, 222 made in the base member 202. This way, different kinds of gaskets can be used, depending on the needs. It is also possible to replace a gasket during a maintenance operation after the installation of the pressure plate assembly 28 without changing the whole base member 202.

Figure 7:
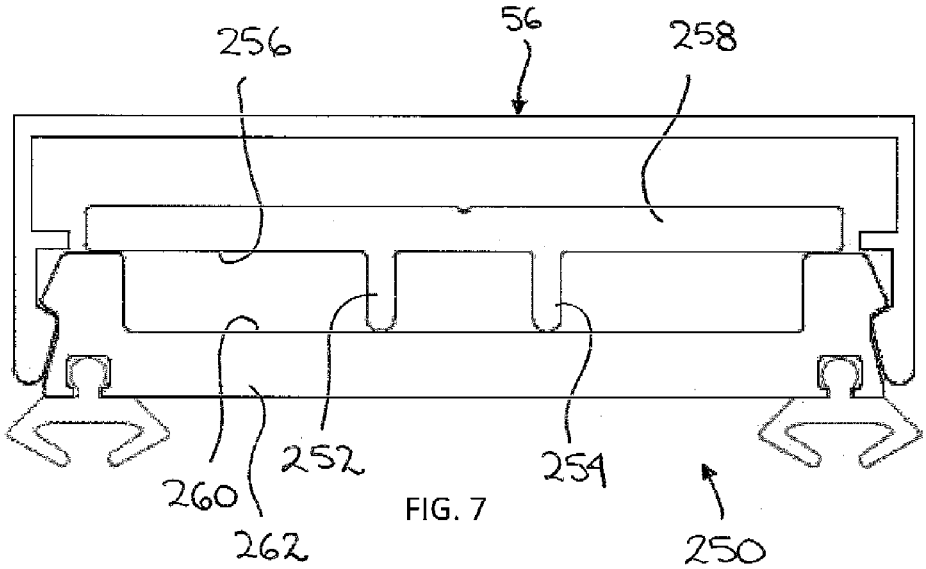
FIG. 7 is a widthwise cross-sectional view illustrating another example of a pressure plate assembly depicting the proposed concept.

FIG. 7 illustrates another example of a pressure plate assembly depicting the proposed concept. The pressure plate assembly in FIG. 7 is referred to hereafter as the pressure plate assembly 250. In this pressure plate assembly 250, two spaced-apart walls 252, 254 project from the interior main face 256 of the stiffening member 258. The free ends of these walls 252, 254 engage a flat bottom surface of a wide central grooved portion 260 made in the base member 262 of the pressure plate assembly 250. This creates three thermal insulation chambers.

Figure 8:
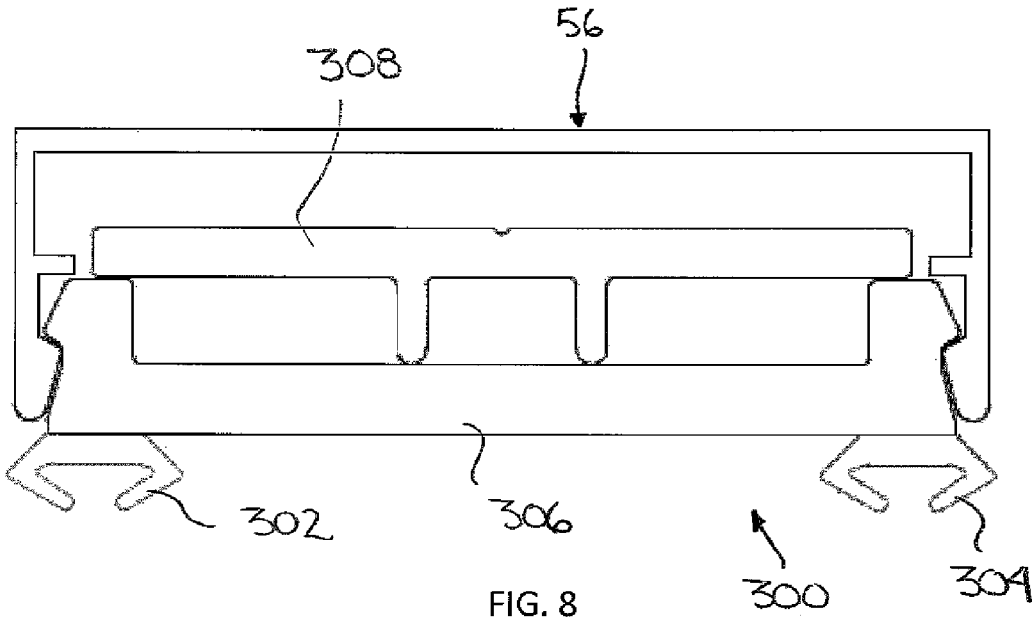
FIG. 8 is a widthwise cross-sectional view illustrating another example of a pressure plate assembly depicting the proposed concept.

FIG. 8 illustrates another example of a pressure plate assembly depicting the proposed concept. The pressure plate assembly in FIG. 8 is referred to hereafter as the pressure plate assembly 300. The pressure plate assembly 300 is similar to the one shown in FIG. 7 but has gaskets 302, 304 made integral, for instance by coextrusion, with the base member 306 of the pressure plate assembly 300. The stiffening member 308 of the pressure plate assembly 300 is identical to the one shown in FIG. 7.

Figure 9:
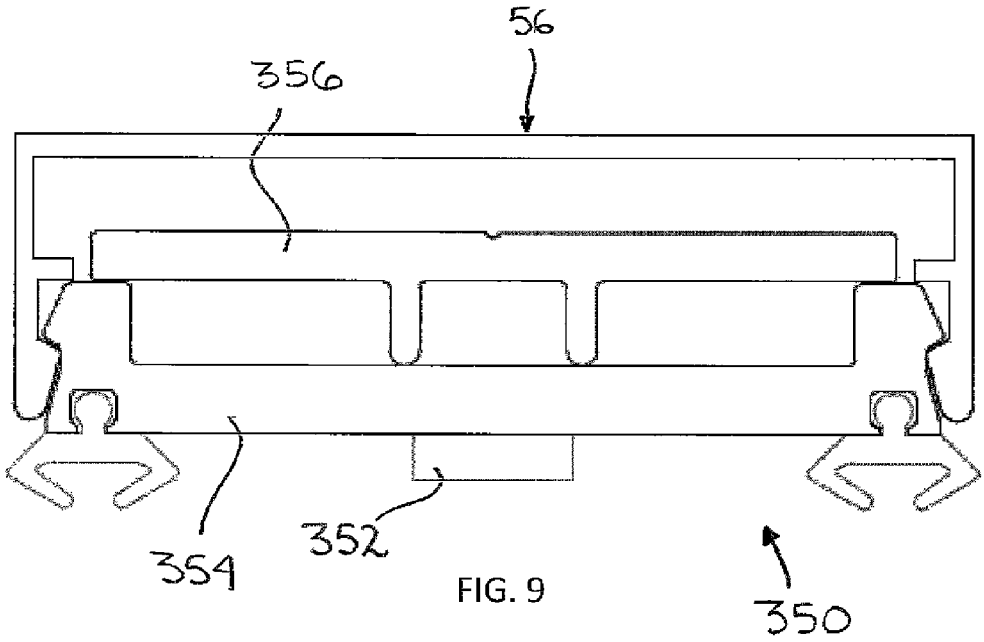
FIG. 9 is a widthwise cross-sectional view illustrating another example of a pressure plate assembly depicting the proposed concept.

FIG. 9 illustrates another example of a pressure plate assembly depicting the proposed concept. The pressure plate assembly in FIG. 9 is referred to hereafter as the pressure plate assembly 350. The pressure plate assembly 350 is similar to the one shown in FIG. 7 but includes a central seal 352 that is made integral, for instance by coextrusion, with the base member 354 of the pressure plate assembly 350. The central seal 352 is somewhat similar to the seal 30 shown in FIGS. 1 and 2. This feature can also be provided in the other illustrated examples. The stiffening member 356 of the pressure plate assembly 350 is identical to the one shown in FIG. 7.

Figure 10:
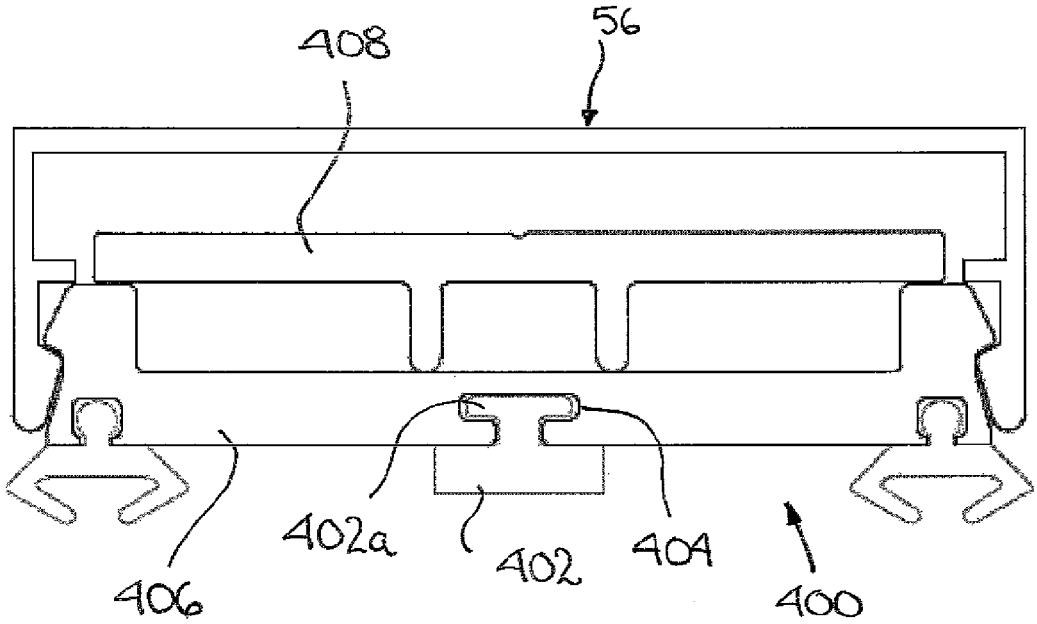
FIG. 10 is a widthwise cross-sectional view illustrating another example of a pressure plate assembly depicting the proposed concept.

FIG. 10 illustrates another example of a pressure plate assembly depicting the proposed concept. The pressure plate assembly in FIG. 10 is referred to hereafter as the pressure plate assembly 400. The pressure plate assembly 400 is similar to the one shown in FIG. 7 but includes a central seal 402 having a rear portion 402*a* inserted into a longitudinally-extending groove 404 made on the base member 406 of the pressure plate assembly 400. This feature can also be provided in the other illustrated examples. The stiffening member 408 of the pressure plate assembly 400 is identical to the one shown in FIG. 7.

Figure 11:
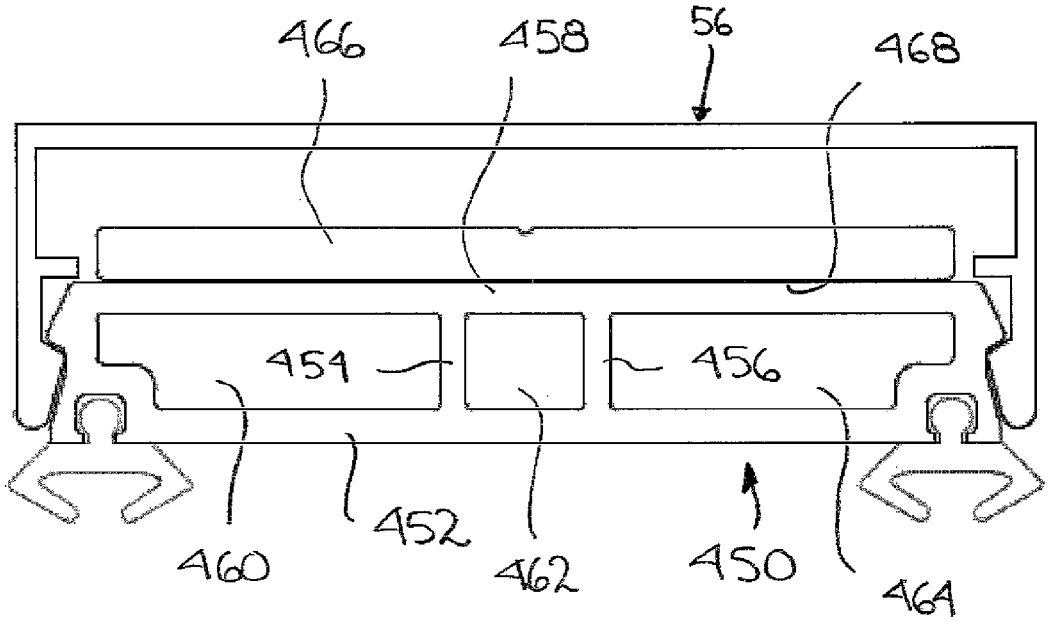
FIG. 11 is a widthwise cross-sectional view illustrating another example of a pressure plate assembly depicting the proposed concept.

FIG. 11 illustrates another example of a pressure plate assembly depicting the proposed concept. The pressure plate assembly in FIG. 11 is referred to hereafter as the pressure plate assembly 450. The pressure plate assembly 450 includes a base member 452 having two spaced-apart and longitudinally-extending walls 454, 456 near the center of the base member 452. The base member 452 also includes a widthwise-extending wall 458. The walls 454, 456, 458 form three longitudinally-extending thermal insulation chambers 460, 462, 464. The stiffening member 466 of the pressure plate assembly 450 has a rectangular cross-sectional profile with a flat main face 468. The main face 468 of the stiffening member 466 engages the exterior side of the wall 458 of the base member 452.

Figure 12:
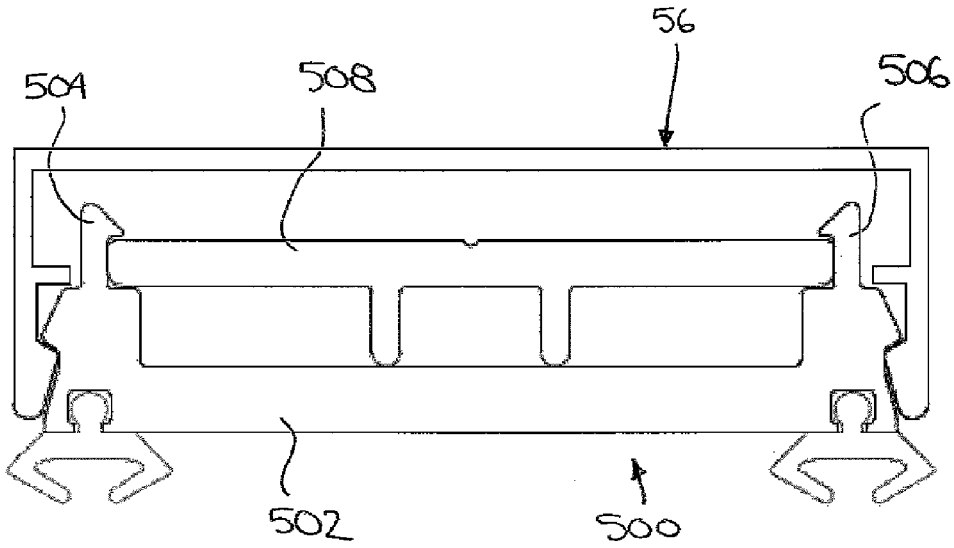
FIG. 12 is a widthwise cross-sectional view illustrating another example of a pressure plate assembly depicting the proposed concept.

FIG. 12 illustrates another example of a pressure plate assembly depicting the proposed concept. The pressure plate assembly in FIG. 12 is referred to hereafter as the pressure plate assembly 500. The pressure plate assembly 500 is similar to the one shown in FIG. 7 but the base member 502 of the pressure plate assembly 500 includes two longitudinally-extending grooved walls 504, 506 projecting from the exterior main face thereof. These grooved walls 504, 506 are similar to the grooved walls 94, 96 shown in FIG. 3 and the stiffening member 508 of the pressure plate assembly 500 is releasably held by the base member 502 using the walls 504, 506 in addition to the fasteners (not shown). This feature can also be provided in the other illustrated examples.

Figure 13:
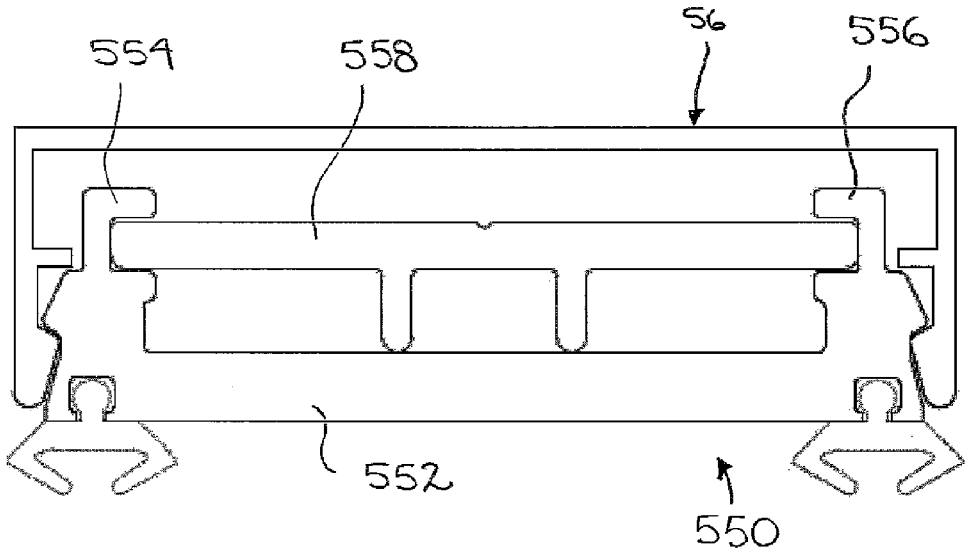
FIG. 13 is a widthwise cross-sectional view illustrating another example of a pressure plate assembly depicting the proposed concept.

FIG. 13 illustrates another example of a pressure plate assembly depicting the proposed concept. The pressure plate assembly in FIG. 13 is referred to hereafter as the pressure plate assembly 550. The pressure plate assembly 550 is similar to the one shown in FIG. 12 but the base member 552 of the pressure plate assembly 550 includes two longitudinally-extending projecting walls 554, 556 having an L-shaped cross-sectional profile. The stiffening member 558 of this pressure plate assembly 550 is inserted or removed from the base member 552 by longitudinally sliding one with reference to the other. This feature can also be provided in the other illustrated examples.

Figure 14:
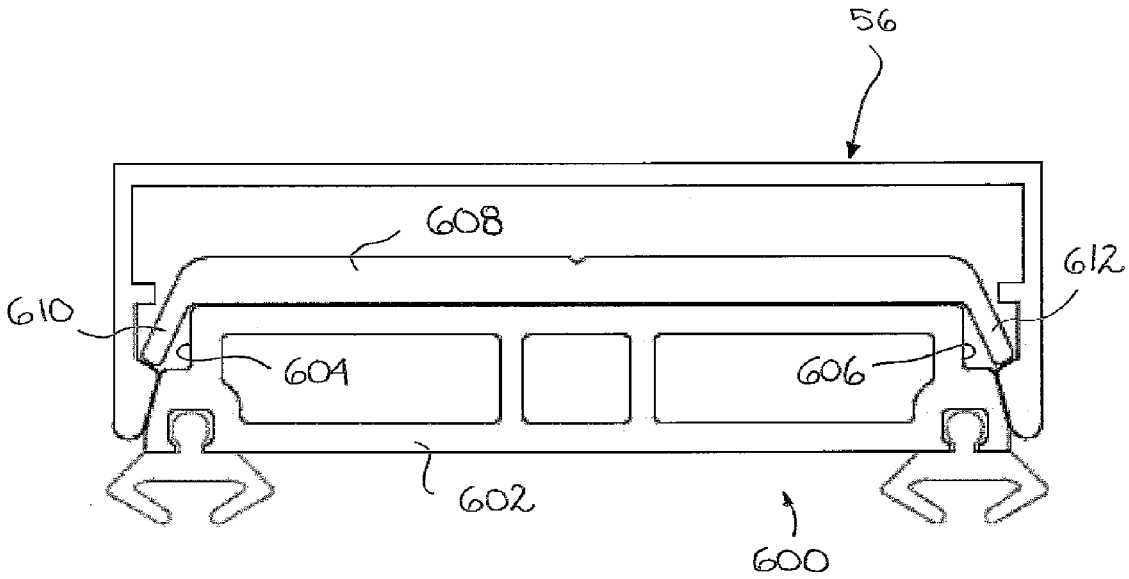
FIG. 14 is a widthwise cross-sectional view illustrating another example of a pressure plate assembly depicting the proposed concept.

FIG. 14 illustrates another example of a pressure plate assembly depicting the proposed concept. The pressure plate assembly in FIG. 14 is referred to hereafter as the pressure plate assembly 600. The pressure plate assembly 600 is somewhat similar to the one shown in FIG. 11 but the base member 602 of the pressure plate assembly 600 has two beveled lateral side portions 604, 606. This base member 602 is smaller in width on its exterior main face than on its interior main face. Also, the stiffening member 608 of the pressure plate assembly 600 has inclined lateral side edges 610, 612. Unlike what is shown with the other examples, the stiffening member 608 in FIG. 14 is larger in width than the base member 602. The cover plate 56 is snap-fitted to the free ends of the side portions 610, 612 of the stiffening member 608 instead of being secured to the base member 602.

Figure 15:
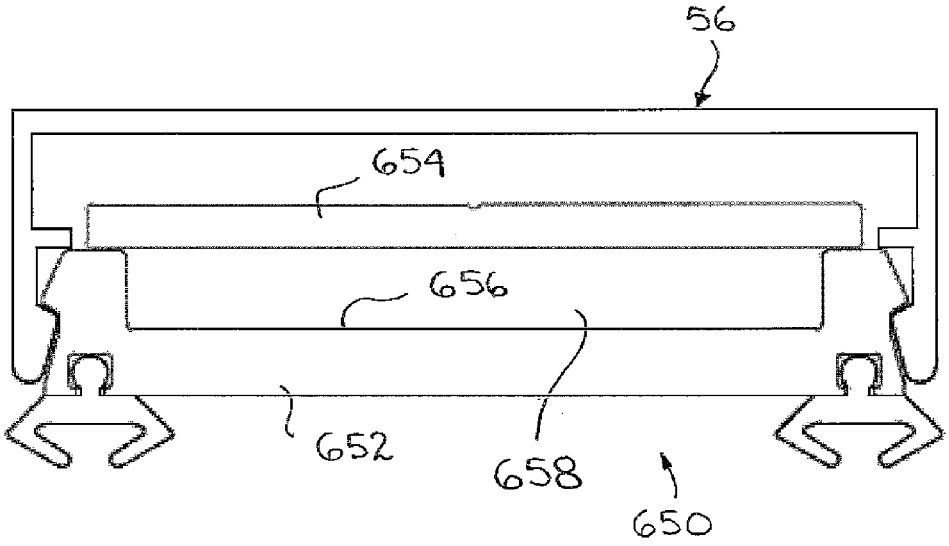
FIG. 15 is a widthwise cross-sectional view illustrating another example of a pressure plate assembly depicting the proposed concept.

FIG. 15 illustrates another example of a pressure plate assembly depicting the proposed concept. This example of a pressure plate assembly is referred to hereafter as the pressure plate assembly 650. The pressure plate assembly 650 is somewhat similar to the one shown in FIG. 7 but the base member 652 and the stiffening member 654 of the pressure plate assembly 650 have no wall or walls separating the space formed by the central grooved portion 656 of the base member 652. Thus, only a single thermal insulation chamber 658 is present across the width of the pressure plate assembly 650.

As can be appreciated, a pressure plate assembly as disclosed in the present specification provides a much greater number of options for the designers of curtain walls without adding complexity to the manufacturing or the installation thereof. The stiffening member enhances the mechanical stress resistance of the base member and provides a more constant pressure distribution of the forces applied by the fasteners. This can allow increasing the spacing between each fastener, for instance. A designer can also design the pressure plate assembly with a very high thermal insulation resistance while keeping manufacturing and installation costs down.

The proposed concept also provides a method of securing a panel to a supporting frame of a curtain wall. The method includes connecting together an elongated base member and a corresponding elongated stiffening member, for instance the base member 32 and the stiffening member 34 shown in FIG. 1. In the method, the base member and the stiffening member remain selectively removable from one another after being connected. The method further includes attaching the base member and the stiffening member to the supporting frame using a plurality of longitudinally spaced-apart fasteners. Each fastener extends in a corresponding fastener hole provided across the base member and the stiffening member. Each fastener generates a compressive force transmitted to the stiffening member around a periphery of the corresponding fastener hole. The compressive force from the fasteners is transmitted to the base member by the stiffener member.

The present detailed description and the appended figures are meant to be exemplary only, and a skilled person will recognize that changes can be made. The following paragraphs give examples of such changes but they are only a subset of all the possible changes and are presented in no particular order.

The various features of the illustrated examples can be combined differently and the shapes and/or the number of the parts can be different compared to what is shown and described. The proposed concept is not limited to the illustrated examples.

A same curtain wall can have different models of pressure plate assemblies.

Materials can be different from those specifically mentioned in the present specification.

The number of projecting walls and the number of thermal insulation chambers can be different to what is shown and described. Also, some or all of the chambers can be filled with another gas than air or be filled with an insulation material that is not a gas, for instance urethane foam or glass wool. Other fillers are possible as well.

A same material can have different mechanical properties resulting from additives, heat treatments, differences in the sizes of the final parts, etc. Therefore, for instance, the material of the base member and the material of the exterior gaskets can be the same initial material having different properties on each part.

The exterior gaskets and/or the seal can be attached differently to the base member compared to what is shown. For instance, it can be glued, welded, etc.

More than two exterior gaskets can be provided on the base member, if necessary in some designs.

The cross-sectional profile of the exterior and/or interior gaskets can be different compared to what is shown in the figures.

Fasteners do not necessarily need to be self-tapping bolts or screws. Other kinds of fasteners are possible as well.

The exterior main face of the stiffening member can have ribs, ridges and/or other reinforcing elements, if necessary, so as to increase its second moment of inertia.

The use of the words "exterior" and "interior", or other related words and expressions, does not exclude curtain walls provided inside a building, for instance on a wall of an atrium. Other situations exist. The use of the words "horizontal" and "vertical", or other related words and expressions, does not exclude variants, for instance a curtain wall designed with oblique mullions.

The illustrated mullion is only one example of a mullion with which a pressure plate assembly can be used. Pressure plate assemblies can be used with other models of mullions or even with other components of a supporting frame that may not always necessarily be called mullions by some persons. In some instances, the supporting frame can possibly be the main frame of the building.

It should be noted that the word "building" is used herein in a broad generic manner and may possibly cover constructions that are not always necessarily referred to as buildings by some persons.

Still many other variants of the proposed concept will be apparent to a skilled person, in light of a review of the present specification.

What is claimed is:

1. A pressure plate assembly for securing curtain wall panels, the pressure plate assembly including:

an elongated base member having opposite exterior and interior main faces and having opposite lateral edges, the base member being made of a first material;

an elongated stiffening member having opposite exterior and interior main faces and having opposite lateral edges, at least a portion of the interior main face of the stiffening member being removably engagable against a corresponding mating surface on the exterior main face of the base member, the stiffening member being substantially similar in length to the base member and being made of a second material having a mechanical stress resistance higher than that of the first material, the second material also having a thermal conduction coefficient higher than that of the first material;

at least one longitudinally-extending thermal insulation chamber provided within a space located between the interior main face of the base member and the interior main face of the stiffening member;

two spaced-apart gaskets attached to the exterior main face of the base member, the gaskets extending parallel in a lengthwise direction of the base member and being adjacent to a respective one of the lateral edges of the base member, the gaskets having an elastic modulus higher than that of the base member; and a plurality of spaced-apart fastener holes, each fastener hole having a first portion extending across both main faces of the stiffening member and a second portion extending across both main faces of the base member, the corresponding first and second portions of each fastener hole being in registry with one another when the pressure plate assembly secures the curtain wall panels.

2. The pressure plate assembly as defined in claim 1, further including a plurality of fasteners, each fastener having a head engaging the exterior main face of the stiffening member and a shank extending through a corresponding one of the fastener holes, the shank including a threaded portion projecting out of the exterior main face of the base member when the pressure plate assembly secures the curtain wall panels.

3. The pressure plate assembly as defined in claim 1, wherein the gaskets are coextruded with the base member and form a monolithic part with the base member.

4. The pressure plate assembly as defined in claim 3, wherein the gaskets are made of the second material, the second material at the gaskets having different properties that of the second material at the base member.

5. The pressure plate assembly as defined in claim 1, wherein there is more than one longitudinally-extending thermal insulation chamber, the chambers being separated from one another in a widthwise direction by at least one longitudinally-extending wall dividing the space located between the interior main face of the base member and the interior main face of the stiffening member.

6. The pressure plate assembly as defined in claim 5, wherein there is more than one longitudinally-extending wall dividing the space located between the interior main face of the base member and the interior main face of the stiffening member, at least one of these walls being made integral with and projecting from the interior main face of the stiffening member.

7. The pressure plate assembly as defined in claim 5, wherein there is more than one longitudinally-extending wall dividing the space located between the interior main face of the base member and the interior main face of the stiffening member, at least one of these walls being made integral with and projecting from the interior main face of the base member.

8. The pressure plate assembly as defined in claim 1, wherein the base member includes means for releasably holding the stiffening member.

9. The pressure plate assembly as defined in claim 1, wherein the stiffening member is smaller in width than the base member.

10. The pressure plate assembly as defined in claim 1, wherein the first material is a polymer and the second material is a metal.

11. The pressure plate assembly as defined in claim 10, wherein the first material includes polyvinyl chloride.

12. The pressure plate assembly as defined in claim 10, wherein the second material includes aluminum or an alloy thereof.

13. The pressure plate assembly as defined in claim 1, wherein the stiffening member includes at least two spaced-apart and longitudinally-extending walls projecting orthogonally from the interior main face of the stiffening member, the at least two projecting walls increasing the rigidity of the stiffening member against flexion.

14. The pressure plate assembly as defined in claim 13, wherein once the stiffening member is engaged against the base member, the at least two projecting walls are located inside corresponding grooves that are longitudinally extending and opened on the exterior main face of the base member.

15. The pressure plate assembly as defined in claim 1, wherein the gaskets are removably attached to the exterior main face of the base member.

16. A pressure plate assembly for securing curtain wall panels, the pressure plate assembly including:

an elongated base member having opposite exterior and interior main faces and having opposite lateral edges, the base member being made of a first material;

an elongated stiffening member having opposite exterior and interior main faces and having opposite lateral edges, at least a portion of the interior main face of the stiffening member being removably engagable against a corresponding mating surface on the exterior main face of the base member, the stiffening member being substantially similar in length to the base member and being made of a second material having a mechanical stress resistance higher than that of the first material, the second material also having a thermal conduction coefficient higher than that of the first material;

at least one longitudinally-extending thermal insulation chamber provided within a space located between the interior main face of the base member and the interior main face of the stiffening member;

two spaced-apart gaskets attached to the exterior main face of the base member, the gaskets extending parallel in a lengthwise direction of the base member and being adjacent to a respective one of the lateral edges of the base member, the gaskets having an elastic modulus higher than that of the base member; and a longitudinally-extending external cover that is snap-fitted to the base member.

17. The pressure plate assembly as defined in claim 16, wherein the cover is substantially C-shaped, the cover having an interior side delimiting a longitudinally-extending space running parallel to the stiffening member when the cover is snap-fitted over the base member.

18. A pressure plate assembly for securing curtain wall panels, the pressure plate assembly including:

an elongated base member having opposite exterior and interior main faces and having opposite lateral edges, the base member being made of a first material;

an elongated stiffening member having opposite exterior and interior main faces and having opposite lateral edges, at least a portion of the interior main face of the stiffening member being removably engagable against a corresponding mating surface on the exterior main face of the base member, the stiffening member being substantially similar in length to the base member and being made of a second material having a mechanical stress resistance higher than that of the first material, the second material also having a thermal conduction coefficient higher than that of the first material;

at least one longitudinally-extending thermal insulation chamber provided within a space located between the interior main face of the base member and the interior main face of the stiffening member;

two spaced-apart gaskets attached to the exterior main face of the base member, the gaskets extending parallel in a lengthwise direction of the base member and being adjacent to a respective one of the lateral edges of the base member, the gaskets having an elastic modulus higher than that of the base member; and a plurality of spaced-apart weep holes, each weep hole having a first portion extending across both main faces of the stiffening member and a second portion extending across both main faces of the base member, the corresponding first and second portions of each weep hole being in registry with one another when the pressure plate assembly secures the curtain wall panels.

* * * * *